United States Patent [19]

Gach

[11] Patent Number: 4,711,372

[45] Date of Patent: Dec. 8, 1987

[54] TAMPER INDICATING CLOSURE

[75] Inventor: Peter P. Gach, Evansville, Ind.

[73] Assignee: Sunbeam Plastics Corporation, Evansville, Ind.

[21] Appl. No.: 9,676

[22] Filed: Feb. 2, 1987

[51] Int. Cl.[4] ..... B65D 41/32; B65D 47/08; B65D 55/06

[52] U.S. Cl. ..... 222/23; 206/807; 215/237; 220/214; 220/254; 220/266; 220/307; 220/338; 222/153; 222/541; 222/546

[58] Field of Search ..... 222/23, 153, 541, 546, 222/556; 206/807; 215/235-237, 250, 251; 220/214, 266, 254, 307, 337-339

[56] References Cited

U.S. PATENT DOCUMENTS

| | | | |
|---|---|---|---|
| 3,838,785 | 10/1974 | Lancesseur | 215/251 |
| 4,344,545 | 8/1982 | Aschberger et al. | 222/541 X |
| 4,361,244 | 11/1982 | Walter | 215/237 X |
| 4,361,250 | 11/1982 | Foster | 222/153 X |
| 4,371,088 | 2/1983 | Gach | 215/220 |
| 4,431,110 | 2/1984 | Roth | 220/307 X |
| 4,462,504 | 7/1984 | Roth et al. | 222/153 X |
| 4,483,449 | 11/1984 | Jones | 215/250 |
| 4,519,517 | 5/1985 | Walter | 222/541 X |
| 4,527,701 | 7/1985 | Schaubeck | 215/220 |
| 4,545,495 | 10/1985 | Kinsley | 220/339 X |
| 4,592,123 | 6/1986 | Libit | 222/23 |
| 4,598,839 | 7/1986 | Dombroski et al. | 222/541 X |
| 4,610,371 | 9/1986 | Karkiewicz | 222/153 X |
| 4,611,725 | 9/1986 | Kacalieff | 222/153 X |
| 4,625,898 | 12/1986 | Hazard | 222/546 X |
| 4,658,980 | 4/1987 | Lindstrom | 220/307 X |
| 4,666,068 | 5/1987 | Bush | 222/546 |

*Primary Examiner*—Joseph J. Rolla
*Assistant Examiner*—Kevin P. Shaver
*Attorney, Agent, or Firm*—Irvin L. Groh; Alfred L. Patmore, Jr.

[57] ABSTRACT

YA tamper indicating dispensing closure for attachment to an originally filled container to indicate prior opening or tampering. The closure has a base cap with a dispensing orifice therethrough and an upstanding retention sleeve. A lid is hinged to the base cap and has a tamper indicating disk attached to it by a pin extending through the lid. In its originally packaged condition, the pin extends into the retention sleeve with the lid closed. A frangible area on the disk around the pin breaks upon initial opening providing evidence of tampering or prior opening.

16 Claims, 5 Drawing Figures

Fig-1
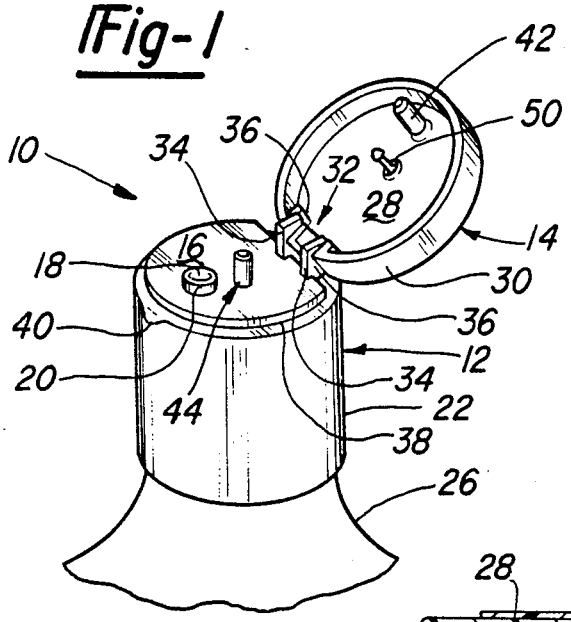
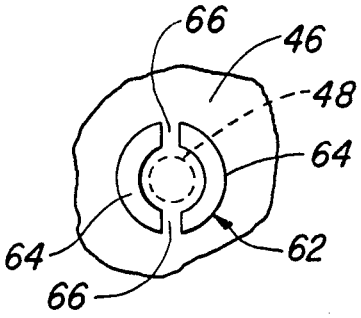
Fig-4
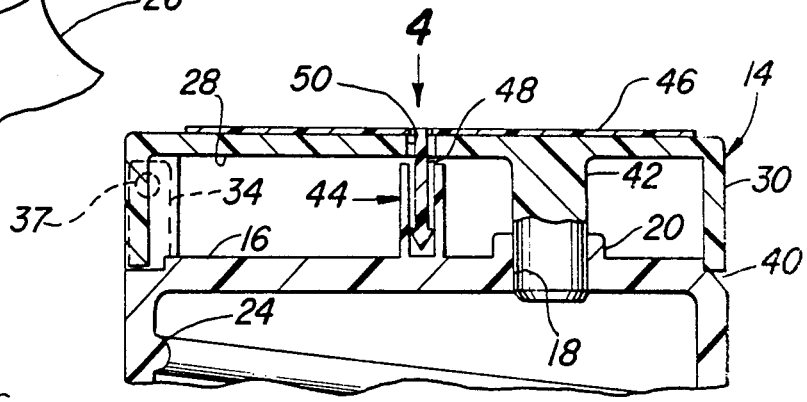
Fig-2
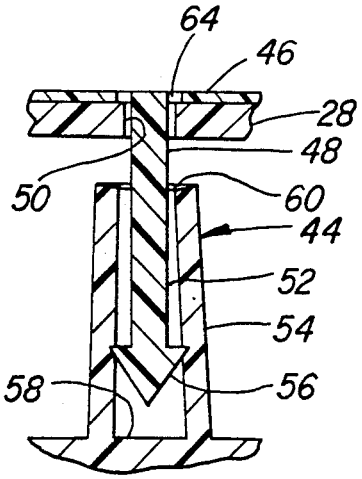
Fig-3
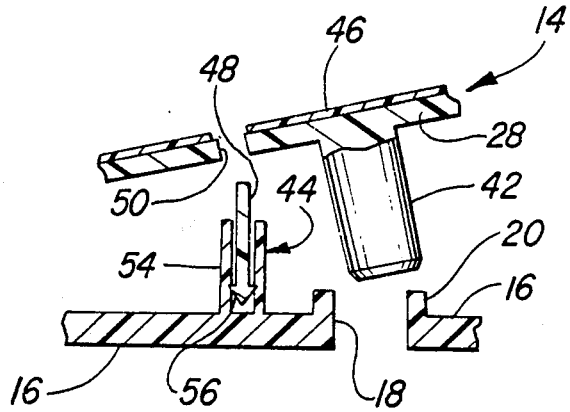
Fig-5

TAMPER INDICATING CLOSURE

This invention relates to a safety closure, and, more particularly, to a tamper indicating closure which indicates to the observer that the container-closure package has not been opened or that it has been opened or been tampered.

There are a wide variety of safety closures which indicate to a perspective purchaser by the condition of the package whether or not it has been opened or tampered. One of the most important criteria in designing such a closure is to provide one that can be applied to the container without destroying the indicia intended to act as a tamper indicator. It is also important to provide the indication which cannot be obscured by a person intentionally tampering with the package. For example, when the tamper indicator is a ring or band attached to the cap by frangible bridges or webs, and high speed packaging equipment is used, care must be taken to avoid fracture of the frangible webs during the packaging process. Likewise, if the frangible webs do not all break at the same time, or the band does not move downwardly on the container neck, the evidence of tampering may be missed by a perspective purchaser.

In instances where the closure is not of the dispensing type, tamper indication can be provided in a two piece closure by providing a worded message which can change from, e.g. "sealed" to "opened". This can be accomplished by the initial relative movement between an outer cap which is threaded on the container neck and an insert which frictionally engages the inside surface of the container neck like a stopper or plug. This structure and other embodiments of this type are shown in U.S. Pat. No. 4,446,979.

In another type of non dispensing closure where a child resistant feature is also incorporated into the two piece closure, the relative movement between an outer driver cap and an inner cap member which threads onto the container neck breaks away a small portion of the outer driver cap to provide tamper indication. This is shown in my U.S. Pat. No. 4,371,088.

In the case of a dispensing closure, tamper indication has been obtained by the use of a pin or pins attached to a lid member by frangible webs, which pin is inserted into an aperture in the base cap and is retained thereby until the initial opening, at which point the webs are broken and the pin is retained in the base cap member. The problem with this arrangement is that it is often difficult to perceive the pin in the cap member unless at least an attempt is made to open the lid, which itself can cause the breakage. Other arrangements which break a substantial portion of the lid away by a retaining pin extending from the lid into the base cap, destroys the utility of the lid in sealing the dispensing orifice.

The instant invention provides a tamper indicating closure which is devoid of the foregoing difficulties associated with tamper indicating enclosures of both the dispensing and nondispensing type. A two piece dispensing closure has a base cap with a top having a dispensing orifice therethrough and a depending annular skirt having means for attachment to a container such as internal threads. A lid is attached to the base cap by a hinge for movement between an open dispensing position and a closed position covering the dispensing orifice. A tamper indicating device takes the form of an upwardly projecting retention sleeve on the base cap top and a tamper indicating disk having a pin projecting therefrom extending through an aperture in the lid and into engagement with the cap retention sleeve when the closure is initially attached to a filled container with the lid in the closed position. The disk has a frangible area circumscribing the pin so that when the lid is initially opened, the pin will be retained by the sleeve breaking away from the disk at the frangible area indicating tampering or initial opening. The broken away area on the disk or the absence of the disk on the cap lid will be readily apparent even to a casual observer, indicating the tampering or initial opening.

The pin can be provided with a barb at its free end for retention within the sleeve, and this barb can take the form of a conical enlargement at the free end of the pin. The sleeve can have a tapered hole with the larger diameter at its end which is attached to the disk and a smaller diameter at its free end to enhance the engagement with the barb. The disk can be made with a color which contrasts with the color of the lid to further enhance the observation of initial opening. the disk itself can have an indicia or legend printed on it such as "SEALED" to indicate package integrity. Likewise, the lid can be imprinted with an indicia such as "OPENED" to indicate initial opening and removal of the tamper indicating disk.

The disk can be molded with a polystyrene plastic to provide a brittle, easily broken frangible area or it may be molded with a low density polyethylene plastic providing a easily torn frangible area.

The lid can be provided with a closure plug aligned to engage the dispensing orifice when the lid is in its closed position. The dispensing orifice and the retention sleeve are arranged in alignment with the hinge, and preferably the retention sleeve is centrally located on the base cap top between the dispensing orifice and the hinge.

The improvements of this invention are accomplished by the embodiment disclosed in the following description and illustrated in the drawing in which:

FIG. 1 is a perspective view showing the closure with the lid in an open position prior to the initial closing in which the barbed pin extending from the tamper indicating disk through the lid will engage the retention sleeve on the base cap;

FIG. 2 is a partial cross sectional view in elevation showing the lid in its closed position with the barbed pin extending from the tamper indicating disk into the retention sleeve;

FIG. 3 is a fragmentary cross sectional view on an enlarged scale showing the engagement of the barbed end of the pin within the retention sleeve;

FIG. 4 is a fragmentary plan view of a portion of the disk showing the frangible area surrounding the point of attachment of the pin to the disk; and FIG. 5 is a fragmentary cross sectional view similar to FIG. 2 showing the breaking away of the pin from the tamper indicating disk and retention of the pin within the cap retention sleeve upon the initial opening of the lid.

Referring to FIG. 1, the two piece dispensing closure 10 include base cap 12 and lid 14. Base cap 12 has a flat top 16 containing a dispensing orifice 18 therethrough with an upstanding annular nozzle 20. Base cap 12 has a depending annular skirt 22 provided with internal threads 24 for engagement with complementary threads on container neck 26.

Lid 14 has a flat top 28 and a depending annular skirt 30. Lid 14 is joined to base cap 12 with a separable hinge 32 which includes a pair of upstanding rectangular posts 34 which are received in slots 36 formed in lid 14. The slots open in the lid top and skirt 30 which permits pivoting of the lid 14 from a closed position to an open dispensing position. The cap posts and the lid side walls forming the slots are provided with curvilinear projections and complementary depressions, shown generally at 37 in FIG. 2, providing a single, stable pivoting axis, as is more clearly shown in U.S. Pat. No. 4,666,068. Base cap 12 is provided with an annular recess 38 at the juncture of top 16 and annular cap skirt 22 to receive lid skirt 30 in flush alignment in the closed position of the lid 14 on cap 12. Cap 12 is also provided with a tapered finger depression 40 for lifting the lid 14 free from the cap 12. Lid 14 is also provided with a depending plug 42 for engagement in sealing relationship with dispensing orifice 18 and upstanding nozzle 20 in the closed position.

Tamper indication is added to dispensing closure 10 by the addition of an integrally molded retention sleeve 44 extending upwardly from the center of base cap top 16. Tamper indicating disk 46 has a pin 48 projecting therefrom extending through an aperture 50 in lid top 28 and into hole 52 for engagement with wall 54 of retention sleeve 44. Pin 48 is provided with a conical barb 56 at its free end for retention in sleeve 44. Also the sleeve hole 52 is tapered from a larger diameter 58 at its disk end to a smaller diameter 60 at its free end to aid in retention of barb 56 within the sleeve. At the point of attachment of pin 48 to the disk 46 a frangible area 62 is provided circumscribing the pin. This can be formed as semi-circular slots 64 through the disk 46 so that the pin is attached to the disk by two diametrically opposed webs 66.

In operation, when the lid 14 is initially closed, plug 42 engages dispensing orifice 18 and nozzle portion 20 while the barbed end 56 of pin 48 engages within retention sleeve 44. Upon initial opening of lid 14, pin 48 will be retained in retention sleeve 44 by the coaction of barb 56 with the sleeve wall 54 and it will be fractured from the disk 46 by breaking or fracture of webs 66. The remaining hole at 62 or the absence of the disk 46 will give the perspective purchaser an indication of prior opening or tampering. Tamper indicating disk 46 can be molded with a color different than the lid 30 to emphasis the breakage. The disk 46 can be molded with a low density polyethylene plastic so that the webs 66 tear away from the balance of the disk, or it can be molded with a polystyrene plastic to create a brittle fracture at webs 66.

The embodiments of the invention in which an exclusive property or privilege is claimed are defined as follows:

1. A tamper indicating dispensing closure for attachment to a container comprising, in combination: a base cap having a top with a dispensing orifice therethrough and with an upwardly projecting retention sleeve thereon and a depending annular skirt having means for attachment to a container; a lid attached to said base cap by a hinge for movement between an open dispensing position and a closed position covering said dispensing orifice; and a tamper indicating disk having a pin projecting therefrom extending through an aperture in said lid and into engagement with said cap retention sleeve when said closure is initially attached to a filled container with said lid in the closed position, said disk being a member separate from the lid, said disk having a frangible area circumscribing said pin; whereby when said lid is initially opened, the pin will be retained by said sleeve breaking away from said disk at said frangible area thereby indicating tampering or initial opening.

2. The tamper indicating dispensing closure of claim 1 wherein said pin is provided with a barb at its free end for retention within said sleeve.

3. The tamper indicating dispensing closure of claim 2 wherein said barb is in the form of a conical enlargement at the free end of said pin.

4. The tamper indicating dispensing closure of claim 2 wherein said sleeve is formed with a hole which tapers from a larger diameter at its end which is attached to the disk to a smaller diameter at its free end to enhance engagement with said barb.

5. The tamper indicating dispensing closure of claim 1 wherein said disk has a color contrasting to the color of said lid.

6. The tamper indicating dispensing closure of claim 1 wherein said disk is molded with a low density polyethylene plastic.

7. The tamper indicating dispensing closure of claim 1 wherein said disk is molded with a polystyrene plastic.

8. The tamper indicating dispensing closure of claim 1 wherein said frangible area is created by attaching said pin to said disk at two diametrically opposed positions.

9. The tamper indicating dispensing closure of claim 1 wherein said pin is attached to said disk by diametrically opposed webs providing two circumferential slots in said disk surrounding said pin.

10. A tamper indicating dispensing closure for attachment to a container comprising, in combination: a base cap having a top with a dispensing orifice therethrough and a depending annular skirt having means for attachment to a container; a lid attached to said base cap by a hinge for movement between an open dispensing position and a closed position over said cap top; a closure plug depending from said lid in a position for engagement with said dispensing orifice when said lid is in a closed position; a retention sleeve projecting upwardly from said cap top; a tamper indicating disk having a pin projecting therefrom extending through an aperture in said lid and into engagement with said cap retention sleeve when said closure is initially attached to a filled container with said lid in the closed position; said disk being a member separate from the lid, and a frangible area on said disk circumscribing said pin; whereby when said lid is initially open, the pin will be retained by said sleeve breaking away from said disk at said frangible area thereby indicating tampering or initial opening.

11. The tamper indicating dispensing closure of claim 10 wherein said dispensing orifice is in line with said hinge.

12. The tamper indicating dispensing closure of claim 11 wherein said retention sleeve is in line with said dispensing orifice and said hinge.

13. The tamper indicating dispensing closure of claim 12 wherein said retention sleeve is located on said cap top centrally thereof.

14. The tamper indicating dispensing closure of claim 13 wherein said retention sleeve is located between said dispensing orifice and said hinge.

15. The tamper indicating dispensing closure of claim 10 wherein said lid has a flat top and a downwardly projecting annular skirt which is in alignment with said cap skirt when said lid is in said closed position.

16. The tamper indicating dispensing closure of claim 15 wherein said hinge includes a pair of posts projecting upwardly from said base cap, each having a side flush with said depending annular cap skirt, and said lid has a pair of slots opening in said lid top and said annular lid skirt, said slots being aligned to receive said posts.

* * * * *